United States Patent [19]

Chainard

[11] Patent Number: 4,826,006

[45] Date of Patent: May 2, 1989

[54] QUICK PACKING FOR DISPLAYING IN LARGE-SCALE DISTRIBUTION OUTLETS AND FOR TRANSPORTING PRODUCTS AS FLUE-BRUSHES

[75] Inventor: Armand Chainard, Givry, France

[73] Assignee: Manufacture Francaise de Brosserie Industrielle, Chalon-sur-Saone, France

[21] Appl. No.: 86,074

[22] Filed: Aug. 17, 1987

[51] Int. Cl.[4] ..... B65D 85/02

[52] U.S. Cl. ..... 206/362.4; 383/10; 383/104; 383/106

[58] Field of Search ..... 206/361, 362.2, 362.4, 206/491, 395; 383/10, 104, 106

[56] References Cited

U.S. PATENT DOCUMENTS

| | | | |
|---|---|---|---|
| 1,373,136 | 3/1921 | Kranz | 383/10 X |
| 1,419,739 | 6/1922 | Kniep | 383/10 |
| 1,876,982 | 9/1932 | Lichter | 383/10 X |
| 3,339,721 | 9/1967 | Goldstein | 383/104 X |
| 3,376,975 | 4/1968 | Brothers | 206/491 |
| 3,847,282 | 11/1974 | Collura et al. | 206/491 |
| 4,243,171 | 1/1981 | Prin | 383/10 X |

FOREIGN PATENT DOCUMENTS

| | | | |
|---|---|---|---|
| 93368 | 2/1959 | Norway | 383/106 |
| 455944 | 10/1936 | United Kingdom | 383/10 |
| 759886 | 10/1956 | United Kingdom | 383/104 |
| 792826 | 4/1958 | United Kingdom | 206/427 |

*Primary Examiner*—William Price

*Attorney, Agent, or Firm*—McAulay, Fields, Fisher, Goldstein & Nissen

[57] ABSTRACT

A quick packing, facilitating transport and display in large-scale distribution outlets, for products such as flue-brushes for cleaning square-, rectangular-or circular-section flues, comprises two rigid side elements, made of material such as corrugated cardboard or other synthetic material, of rectangular form of which the width is at least equal to the largest dimension of said products. The bottom of the packing, connected to the two side elements, is provided with two side flaps of sufficient height, automatically cooperating, by adequate folding means, with the two side elements, becoming perpendicular thereto. The assembly thus formed is in the form of a trough adapted to ensure lateral holding of the products. In the top of the packing it comprises means for rapidly assembling the side elements previously brought "edge to edge", as well as a cut-out on each of the side elements to form a handle for transporting purposes.

20 Claims, 2 Drawing Sheets

QUICK PACKING FOR DISPLAYING IN LARGE-SCALE DISTRIBUTION OUTLETS AND FOR TRANSPORTING PRODUCTS AS FLUE-BRUSHES

BACKGROUND OF THE INVENTION

The present invention relates to a quick packing for displaying in large-scale distribution outlets and for transporting products as flue-brushes.

A flue-brush is generally constituted by at least two metal discs of which the fine radial cut-outs, bent in quincunx, procure the effect of a metal brush over the whole periphery of the discs. Furthermore, the brush comprises at its centre gripping means such as a hand-hold or any other device in which are fixed sticks, with or without extensions; the flue-brush thus presents at its centre various projecting elements which obviously raise problems of packing.

This type of product is certainly particularly inconvenient to pack and transport, firstly for its lack of intrinsic and functional rigidity; the blades of the discs must be protected, and finally because its dimensions do not come, by far, within the standards of conventional packings, particularly cardboard packings.

Consequently, manufacturers of flue-brushes pack this type of product in simple, conventional, parallelepipedic packings, made of cardboard for example, which present the following drawbacks:

difficulty of maintaining the flue-brush in the "cardboard box", the latter resting on its central gripping devices and in abutment on the fragile part of the flue-brush located on the periphery;

difficulty of wedging in such "cardboard boxes" unless expensive distance pieces made of cardboard or expanded polystyrene are used;

waste of space when storing said packings;

display for selling purposes offering minimum promotion as these cardboard boxes are stacked on the shelves: in particular, there is no possibility of displaying the product per se, unless it is exhibited outside its box with all the inherent risks of deterioration that this involves;

difficulty of transport for the customer in a "supermarket" type outlet: the drawbacks of purchasing such packings, where both hands are needed to carry them, are known, any other purchase being impossible, unless especially adapted means are available;

difficulty connected with the packing time spent by the manufacturer at the end of the production line.

SUMMARY OF THE INVENTION

It is an object of the present invention to overcome these drawbacks by providing a novel type of quick packing, facilitating transport and display in large-scale distribution outlets, for products such as flue-brushes for cleaning square-, rectangular- or circular-section flues, characterized in that said products are "sandwiched" between two rigid side elements, made of material such as corrugated cardboard or other synthetic material, of rectangular form of which the width is at least equal to the largest dimension of said products and whose length is sufficient, on the one hand, at the bottom of the packing, to articulate on a common bottom connecting the two side elements, this bottom being provided with two side flaps of sufficient height, automatically cooperating, by adequate folding means, with the two side elements, becoming perpendicular thereto, the assembly thus formed being in the form of a trough adapted to ensure lateral holding of the products and advantageously to serve as a spacer member between the two side elements, in order to avoid said products being crushed, and, on the other hand, in the top of the packing, to comprise means for rapidly assembling the side elements previously brought "edge to edge", as well as a cut-out on each of the side elements to form a handle for transporting purposes.

The assembly described hereinabove unexpectedly constitutes a simple solution to the problem of packing a flue-brush, the latter being disposed in abutment on the bottom through and on one of the side elements, the axial gripping means of said flue-brush coming inside a cut-out provided on this side element, thus enabling the flue-brush to rest flat on the same side element; it then suffices to fold down the second side element which comprises adequate cut-outs to escape the central hub and, after fixation of the upper edges of the two side elements, the assembly constitutes a facial protection of the flue-brush retained at the bottom by the bottom trough and laterally by the side flaps of said bottom trough.

Accessory means, such as a handle for transport in the top of the packing and a description and information printed thereon, will advantageously complete this novel packing.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
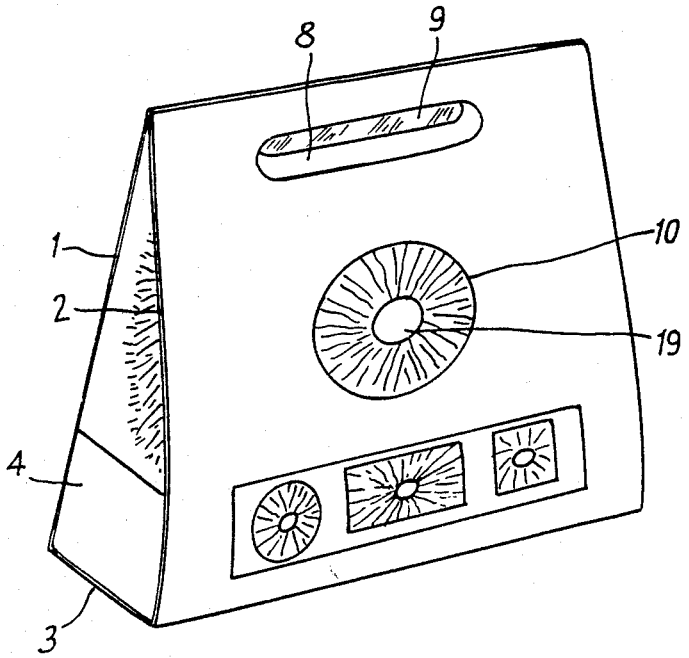
FIG. 1 is a view in perspective of the packing containing a flue-brush.
Figure 2:
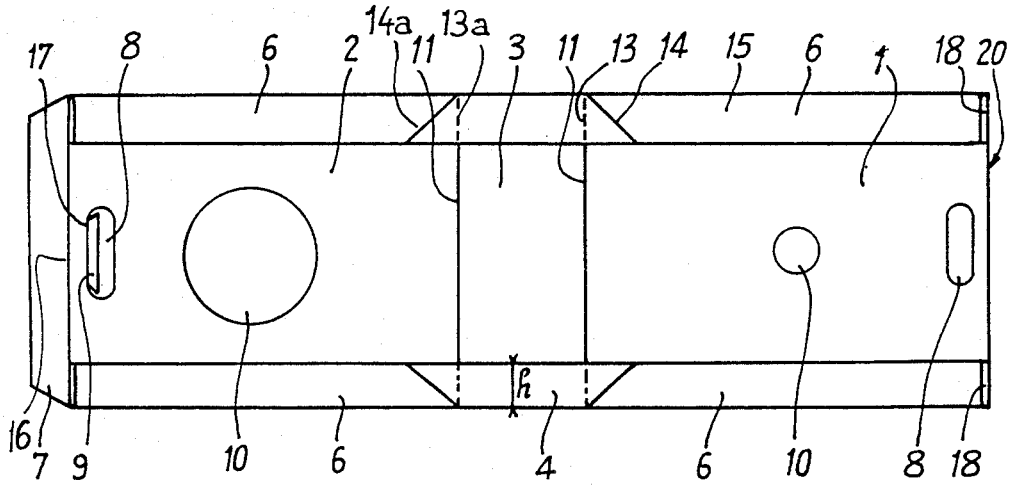
FIG. 2 is a plan view of the packing opened out, in its form before use.

Referring now to the drawings, and firstly to FIG. 2, the packing according to the particular embodiment of the invention is constituted by a rectangular sheet of corrugated cardboard presenting successively, from left to right, a zone 7 constituting the tongue for closing the mounted device, a side element 2 corresponding to the front part of the packing, a zone 3 of width substantially equal to the thickness of the flue-brush and constituting the bottom trough of the packing, and a side element 1 of the same dimensions as the side element 2 and corresponding to the rear part of the finished packing.

All parts 1, 2, 3 and 7 are articulated on one another along lines of fold 11, 11a and 16 preformed on the inner faces of the packing.

The side elements 1 and 2 comprise special cut-outs 8 adapted respectively to constitute a handle for transport provided with a piece 9 issued from a cut-out and articulated at 17 to avoid hurting the fingers during transport. Other cut-outs 10 are provided and to receive the axial parts in relief of the flue brush fitting in the cut-outs 10 in the side elements 1 and 2.

On either side of the plane constituted by the part 1, 3, 2, 7, there extends lateral flaps 6 completely folded on said plane along a line of fold. This flap 6 has a width equal to the height of the flaps 4 of the bottom trough. The flap 6 comprises in its median part, in superposition of the zone 3 of the bottom, two preformed folds 13 and 13*a* made on the inner face of the flap 6 colinearly with respect to lines of fold 11 and 11*a*. Similarly, two preformed lines of fold 14 and 14*a* on the outer face of the flap 6 extend respectively from the intersections of lines 11 and 13 and 11*a* and 13*a* up to the edge of the flap, at an angle of 45°.

Figure 3:
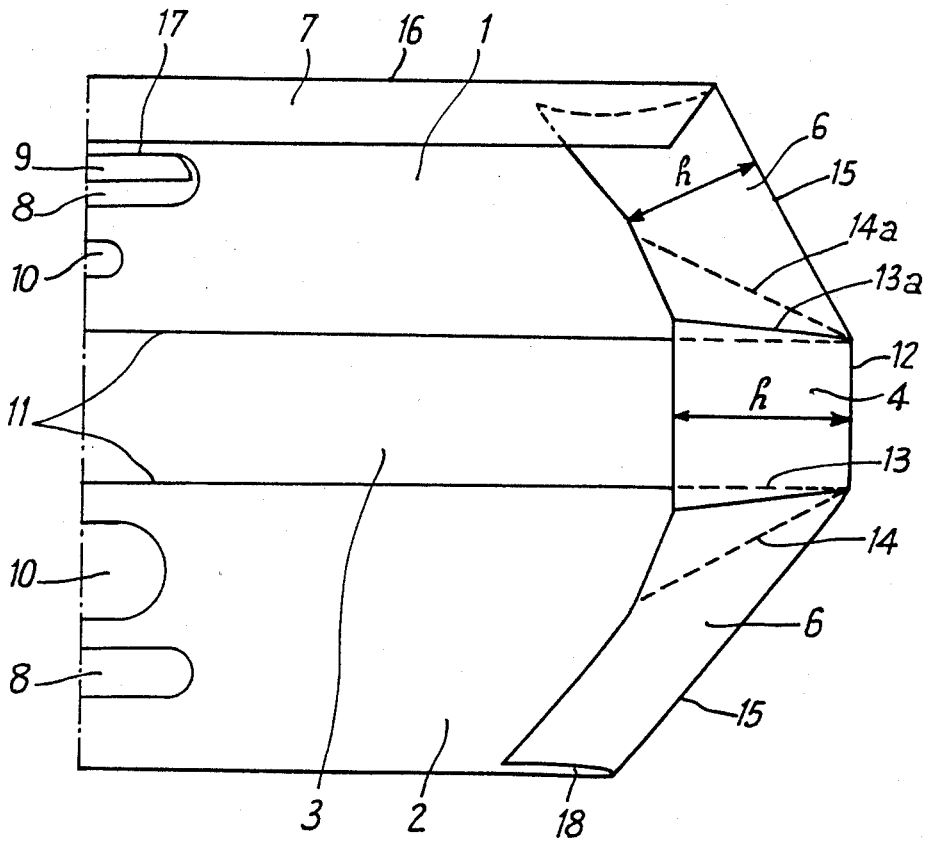
FIG. 3 is a half-view of the package in semi-folded position presenting the formation of the bottom trough.

When, in accordance with FIG. 3, the two side elements 1 and 2 are folded along the lines of fold 11 and 11a to bring their upper edges 20, 16 into register, the part 4 of the flap 6, comprises between the lines of fold 14 and 14*a*, thus rises thanks to the folds 13, 13*a* and 14, 14*a*, to constitute, over a height h, the two lateral flaps of the bottom trough perpendicular to the bottom 3 and to the side elements 1 and 2.

The quick packing thus constituted is maintained in closed position for display and transport thanks to the tongue 7 introduced, to that end, in the folds 18 of the flaps 6 on the side element 1. Thanks to cut out 8, the packing may advantageously be presented "linearly" in the shelves of a large-scale distribution outlet and the surface of the side elements 1 and 2 may be used for showing indications useful for promoting and using the products contained therein, particularly flue-brushes for cleaning flues.

I claim:

1. A quick packing for facilitating transport and displayiing in large-scale distribution outlets, for products such as flue-brushes for cleaning square, rectangular or circular-section flues, comprising:

a rectangular bottom having opposite length sides and opposite width sides with a width dimension and length dimension greater than the width dimension, the width dimension being sufficient to accomodate the largest width dimension of the products;

first and second rigid side elements connected with said bottom along the length sides on opposite sides of the width dimension for sandwiching therebetween the product, each of said rigid side elements being made of a material such as corrugated cardboard or other synthetic material, each said rigid side element being of rectangular form having a pair of opposite length and width edges and having a width dimension at least equal to the length dimension of said bottom and a width dimension to accomodate the products and sufficient at the bottom of the packing to articulate along the length side of the bottom connecting the side elements to the length sides of said bottom;

two side flaps pivotally connected to said bottom along said opposite width sides, each of said side flaps being of sufficient height and automatically cooperating, by adequate folding means, with said two side elements and becoming perpendicular thereto, each of said side flaps having one end pivotally connected with said bottom along said width side and a free end substantially parallel thereto, the assembly thus formed being in the form of a trough adapted to ensure lateral holding of the products and advantageously to serve as a spacer member between said two side elements, in order to avoid said products being crushed;

means at the top of said packing including a tongue element extending solely from one side element and engaging means on the other side element for rapidly assembling the side elements previously brought together "edge to edge";

a cut-out on each of said side elements brought together by said tongue element engaging said engaging means to form a handle for transporting purposes; and an additional cut-out on each side of said elements for exposing the product to view and holding the product in position between said side elements in position when said tongue element is engaged with said engagement means.

2. The packing according to claim 1, wherein:

in a completely opened-out position, said side elements, said tongue element and the bottom are merged into the same plane;

said tongue element having a width equal to the width of each of said side elements;

two opposite edges of said side elements in said plane along its length with said bottom between said side elements, each comprise a pair of lateral flaps of a width equal to the height of the flaps of the bottom trough and extending along said length edges so that the width of said side elements and the width of said flaps if greater than the width of said tongue element; and each said lateral flap being completely folded onto said side element from which it extends; and said lateral flaps each comprising:

two first lines of fold extending in line with the length edges of said bottom and lines of articulation of said side elements with said bottom, the lines of fold being made on the inner face of the flap;

two second lines of fold extending at an angle of 45° from one edge of the flap to the other from the intersection of said lines of articulation and said first lines of fold, the intersection of said lines of fold being at the outer edges, the second lines of fold being made on the outer face of the flap so that, when said side elements are brought together to bring the upper edges into registry, the bottom trough is automatically formed by the play of the lines of fold and articulation; and further line of fold between said tongue element and said one of said side elements for articulation of said tongue element relating to said one side element.

3. The packing according to claim 2, wherein:

said tongue element extends over the whole edge and articulated along a line of fold with said engagement means; said engagement means including an interstice so that said tongue element is intercalated into the interstice between the other side element and its lateral flap, thus constituting a fixation of said two side elements, by penetration of said tongue element into said interstice to align said cut-outs with each other.

4. The packing according to claim 1, wherein said additional cut-outs in said side elements are circular and the product is engaged in said circular cut-outs and which together with said trough fixes a flue-brush in place in said packing.

5. The packing according to claim 1, wherein the cut-out on one of said side elements comprises a piece issuing from the cut-out and is bent in order to avoid injuring the fingers on the edge of the cut-out when the cut-outs together are used as a handle for transporting the packing, said piece being pivotally connected to said cut-out on said one side element.

6. A blank of cardboard or like material for a package for a quick packing for facilitating transport and displaying in large scale distribution outlets, for products such as flue-brushes for cleaning square, rectangular or circular section flues, comprising:

an elongated substantially rectangularly-shaped member having a length and a width dimension, said length dimension being greater than said width dimension;

first and second spaced substantially parallel fold lines extending along said length dimension and spaced from each length edge forming first flap and second flap members;

third and fourth fold lines substantially orthogonally relates to said first and second fold lines and extending along said width dimension and spaced from each other and from each width edge, to form therebetween and with said first and said second fold lines a base zone, and first and second base zone sides formed between one of said third and fourth fold lines and the width edge closest thereto, respectively to form first and second sides connected with said first and second flap members and a base member between said sides;

fifth and sixth fold lines formed on said first flap member starting at the intersection of said first and third fold lines and extending in a direction non-parallel to the first four fold lines towards a free edge of said first flap member and the width edge closest thereto forming an acute angle with said first and third fold lines to form a first base flap having one side connected with said base zone and the other side free and separating said firt flap member into first and second flaps on either side of said first base flap;

seventh and eighth fold lines formed on said second flap member starting at the intersection of said second and fourth fold lines and extending in a direction towards the edge of said second flap and the width edge closest thereto forming an acute angle with said second and fourth fold lines, to form a second base flap having one side connected with said base zone and the other side free and separating said second flap member into third and fourth flaps on either side of said second base flap, each of said other sides having a width greater than the distance between said third and fourth fold lines, such that the distance between said first and second sides when folded to form a package is greater at the area of said other sides than at said base between said first and second sides;

a tongue portion connected with solely one of said sides;

a ninth fold line extending along said width dimension orthogonally related to said first and said second fold lines and parallel to said third and fourth fold lines to form engagement means for said tongue portion, said engagement means being formed by one of said first and second flap members to form interstices for said tongue portion when said blank of cardboard is folded to form the packing and to facilitate the quick closing of the packing; and said first and second sides each having the same dimension, and said tongue portion together with the side to which it is attached increasing the overall length dimension of the combination of said last-mentioned side and said tongue portion.

7. The blank as claimed in claim 6, wherein said acute angle is 45°.

8. The blank as claimed in claim 6, wherein said first and said second sides each have a cut-out substantially aligned with each other forming a part of the handle for the package when folded to form the package.

9. The blank of claim 8, including a piece extending from one of said cut-outs and articulated thereto to engage the other cut-out to avoid hurting the fingers of a user when folded to form a package and containing a product during transport.

10. The blank of claim 9, wherein the same side includes said tongue portion extending therefrom and said piece extending from said one of said cut-outs.

11. The blank of claim 8, including a circular cut-out in each of said sides.

12. The blank of claim 10, wherein said cut-outs are of an oblong configuration.

13. The blank of claim 6, wherein each of said sides have a circular cut-out with the cut-out in one of said sides being different from the cut-out in the other of said sides so that the circular cut-outs act as individual holders for the part in the package when the blank is formed into a package and contains the product.

14. A quick packing for facilitating transport and displaying in large-scale distribution outlets, for products such as flue-brushes for cleaning square, rectangular or circular-section flues, comprising:

a bottom having opposite length sides and opposite width sides with a length dimension and a width dimension being sufficient to accomodate the largest length and width dimension of the products;

first and second substantially rigid side elements connected with said bottom, each of said side elements being of the same outer dimension, one along each said length sides on opposite sides of the width dimension for sandwiching therebetween the product, each of said substantially rigid side elements being made of a material such as corrugated cardboard or other synthetic material, each said rigid side element having a pair of opposite length and width sides and having a first dimension at least equal to the length dimension of said bottom and a second dimension to accomodate the products and sufficient at the bottom of the packing to articulate along the length side of the bottom connecting the side elements to the length sides of said bottom;

two bottom side flaps pivotally connected to said bottom along said opposite width sides, each of said side flaps being of sufficient height and automatically cooperating, by adequate folding means, with said two side elements and becoming perpendicular thereto, each of said side flaps including two non-parallel sides and two substantially parallel sides, one of said substantially parallel sides forming one end pivotally connected with said bottom along said width side and a free end, said other of said substantially parallel sides forming the lateral extent of said free end, the assembly thus formed being in the form of a trough adapted to ensure lateral holding of the products and advantageously to serve as a spacer member between said two side elements, in order to avoid said products being crushed;

a tongue portion connected to one of said sides pivotally connected with said one of said sides and engagement means formed at the other of said sides, for engagement with said tongue portion for locking said sides together to form said quick packing; and a cut-out on each of said side elements for exposing the product to view and at the same time holding the product in position between said side elements in position when said tongue element is engaged with said engagement means.

15. The packing according to claim 14, wherein in a completely opened-out position, the side elements and the bottom are merged into the same plane, the two opposite edges of each said side elements in said plane along its length with said bottom between said side elements, each comprise a pair of lateral flaps of a width equal to the height of the flaps of the bottom trough and extending along said length sides, and each said lateral flaps being completely folded onto said side element from which it extends and said lateral flaps connected to the side element without said tongue portion being foreshortened to form said engagement means;

said lateral flaps each comprising:

two first lines of fold extending in line with the length sides of said bottom and lines of articulation of said side elements with said bottom, the lines of fold being made on the inner face of the flap; and two second lines of fold extending at an angle of 45° from one end of the flap to the other from the intersection of said lines of articulation and said first lines of fold, the intersection of said lines of fold being at the outer edges, the second lines of fold being made on the outer face of the flap so that, when said side elements are brought together to bring the upper edges into registry, the bottom trough is automatically formed by the play of the lines of fold and articulation with said tongue portion engaged by said engagement means.

16. The packaging according to claim 15, including means at the top of said packing or rapidly assembling the side elements previously brought "edge to edge", and having a cut-out on each of the side elements to form a handle for transporting purposes, said tongue portion extending over the whole edge of one of said side elements and being articulated along a line of fold so as to be intercalated by said engagement means which includes an interstice and intercalcated into the interstice between the other side element and its lateral flap, thus constituting a fixation of said two side elements, by penetration of said tongue portion into said interstice, and said cut-out on one of said side elements comprising a piece issuing therefrom and bent over the other cut-out in order to avoid injuring the fingers on the edge of the cut-out when the cut-outs together are used as a handle for transporting the packing.

17. The packing according to claim 15, including an additional cut-out on each of said side elements for exposing the product and holding it in position between said side elements, said additional cut-outs being circular in outline, and the product being engaged in said circular cut-outs and cooperating with said trough for fixing a flue-brush in place in said packing.

18. A blank of cardboard or like material for a package for a quick packing for facilitating transport and displaying in large scale distribution outlets, for products such as flue-brushes for cleaning square, rectangular or circular section flues, comprising:

an elongated substantially rectangularly-shaped member having a length and a width dimension, said length dimension being greater than said width dimension;

first and second spaced substantially parallel fold lines extending along said length dimension and spaced from each length edge forming first flap and second flap members;

third and fourth fold lines substantially orthogonally related to said first and second fold lines and extending along said width dimension and spaced from each other and from each width edge, to form therebetween and with said first and said second fold lines a base zone, and first and second base zone sides formed between one of said third and fourth fold lines and the width edge closest thereto, respectively to form first and second sides connected with said first and second flap members and a base member between said sides;

fifth and sixth fold lines formed on said first flap member starting at the intersection of said first and third fold lines and extending in a direction non-parallel to the first four fold lines towards a free edge of said first flap member and the width edge closest thereto forming an acute angle with said first and third fold lines to form a first base flap having one side connected with said base zone and the other side free and separating said firt flap member into first and second flaps on either side of said first base flap;

seventh and eighth fold lines formed on said second flap member starting at the intersection of said second and fourth fold lines and extending in a direction towards the edge of said second flap and the width edge closest thereto forming an acute angle with said second and fourth fold lines, to form a second base flap having one side connected with said base zone and the other side free and separating said second flap member into third and fourth flaps on either side of said second base flap, each of said other sides having a width greater than the distance between said third and fourth fold lines, such that the distance between said first and second sides when folded to form a package is greater at the area of said other sides than at said base between said first and second sides;

a tongue portion connected with solely one of said sides;

a ninth fold line extending along said width dimension orthogonally related to said first and said second fold lines and parallel to said third and fourth fold lines to form engagement means for said tongue portion, said engagement means being formed by one of said first and second flap members to form interstices for said tongue portion when said blank of cardboard is folded to form the packing and to facilitate the quick closing of the packing; and each of said sides having a circular cut-out with the cut-out in one of said sides being different from the cut-out in the other of said sides so that the circular cut-outs act as individual holders for the part in the package when the blank is formed into a package and contains the product.

19. The blank of claim 18, wherein said first and said second sides each have a cut-out substantially aligned with each other forming a part of the handle for the package when folded to form the package.

20. The blank of claim 19, including a piece extending from one of said last-mentioned cut-outs and articulated thereto to engage the other cut-out to avoid hurting the fingers of a user when folded to form a package and containing a product during transport.

* * * * *